US005951907A

United States Patent [19]

Kang

[11] Patent Number: 5,951,907

[45] Date of Patent: Sep. 14, 1999

[54] EXHAUST STRUCTURE FOR VENTILATION-HOODED MICROWAVE OVENS

[75] Inventor: Myung Yeol Kang, Changwon, Rep. of Korea

[73] Assignee: LG Electronics, Inc., Seoul, Rep. of Korea

[21] Appl. No.: 08/998,455

[22] Filed: Dec. 24, 1997

[30] Foreign Application Priority Data

Mar. 8, 1997 [KR] Rep. of Korea ..... 97-7838

[51] Int. Cl.[6] ..... H05B 6/80; F24C 15/30

[52] U.S. Cl. ..... 219/757; 126/21 A; 126/299 D

[58] Field of Search ..... 219/757, 756; 126/21 A, 198, 299 R, 299 D

[56] References Cited

U.S. PATENT DOCUMENTS 4,297,558 10/1981 Inayama et al. ..... 219/757

4,327,274 4/1982 White et al. ..... 219/757

4,418,261 11/1983 Jailor et al. ..... 219/757

5,042,458 8/1991 Spencer et al. ..... 219/757

5,814,793 9/1998 Yu ..... 219/757

*Primary Examiner*—Philip H. Leung

[57] ABSTRACT

An exhaust structure for ventilation-hooded microwave ovens is disclosed. The exhaust structure includes an exhaust motor mounted to the rear portion of an air duct, an instrument compartment divided into front and rear portions by an air guide plate, an internal exhaust passage formed at the rear portion of the instrument compartment, and a lower panel mounted at the lower portion of the instrument compartment. Electronic equipment, used for generating microwaves, is installed at the front portion of the instrument compartment. The lower panel has exhaust holes communicating with the internal exhaust passage, thus allowing the exhaust passage to be linearly formed on the same plane at a position between the exhaust motor and the lower panel.

14 Claims, 4 Drawing Sheets

EXHAUST STRUCTURE FOR VENTILATION-HOODED MICROWAVE OVENS

BACKGROUND OF THE INVENTION

Field of the Invention

The present invention relates, in general, to an exhaust structure for ventilation-hooded microwave ovens, and more particularly, to an improved exhaust structure provided with an internal exhaust passage, linearly formed in an instrument compartment and positioned on the same plane, the passage being from the upper to the rear portions of the compartment, thereby increasing the exhaust efficiency.

Description of the Background Art

As well known to those skilled in the art, in a conventional OTR (over the range), a microwave oven is installed over a gas oven and generates microwaves to heat food in its cooking cavity. A collateral function of the microwave oven is to exhaust smoke of the gas oven into the atmosphere.

FIG. 1 is a schematic view showing the construction of a conventional ventilation-hooded microwave oven.

As shown in FIG. 1, such a microwave oven comprises a cavity assembly 10, including a cavity 12 for cooking, and an instrument compartment 14 mounted to the outside wall of the cooking cavity 12. Electronic equipment is embedded in the instrument compartment 14, while an air duct 20 is mounted to the top portion of the cooking cavity assembly 10.

A magnetron mount plate 13 is protrudently mounted in the instrument compartment 14. Also, both the electronic equipment for generating microwaves and an exhaust passage serving to ventilate smoke are mounted in the instrument compartment 14.

A magnetron 16, for oscillating microwaves, is fixed to the mount plate 13, while a high voltage transformer 11, for supplying a high voltage to the magnetron 16, is mounted to the rear panel 10*b* of the instrument compartment 14.

A lower panel 18, consisting of the lower portion of the instrument compartment 14, is mounted to the front and rear panels 10*a* and 10*b* using a plurality of screws. A fan motor assembly 15, for both radiating the heat of the electronic equipment and exhausting the smoke of the cooking cavity into the atmosphere, is mounted in such a manner that the fan motor assembly 15 is spaced apart from the right-side portion of the magnetron 16 by a predetermined gap. In addition, a condenser 19 is mounted in the instrument compartment 14, while exhaust channel 18*a*, forming a separated exhaust passage, are formed on the right-side portion of the lower panel 18 as shown in FIG. 1.

As mentioned above, after the electronic equipment is embedded in the instrument compartment 14, the electronic equipment is covered with an air guide plate 17 so that the exhaust passage is formed so as to connect the exhaust channel 18*a* to the air duct 20. That is, the right-side portion of the instrument compartment 14, corresponding to the exhaust channel 18*a* of the lower panel 18, is covered with the air guide plate 17, thereby forming the right-side portion of the instrument compartment 14 into the exhaust passage. Preferably, the guide plate 17 has an almost L-shaped cross-section.

An exhaust motor 22 is mounted at a position around the rear portion of the air duct 20. The exhaust motor 22 serves to generate an air current at the exhaust passage, which communicates with a base panel 30 (illustrated in FIG. 2) of the microwave oven, a part of the instrument compartment 14 and the rear portion of the air duct 20.

FIG. 2 is a view illustrating the construction of the conventional microwave oven.

As shown FIG. 2, the intake air, passing through the side portion of the air duct 20, is exhausted into the atmosphere through the top portion of the air duct 20. The rear portion of the air duct 20 communicates with the exhaust passage of the instrument compartment 14. That is, the front portion 23 of the air duct 20 is closed, while the rear portion 24 of the air duct 20 communicates with the rear portion of the instrument compartment 14.

The top portion of the air duct 20 is covered with a cover 34, having exhaust holes 34*a* in such a manner that intake air is exhausted into the atmosphere through the exhaust holes 34*a*. The base panel 30, consisting of the floor portion of an outer casing, is mounted to the lower panel 18 having exhaust channel 18*a*. Also, a filter 32 is mounted to the base panel 30 so as to purify the exhaust air.

The exhaust function of the conventional ventilation-hooded microwave ovens is described below.

When a user cooks at the gas oven installed under the microwave oven, the exhaust air, such as a smoke, is generated from the cooking cavity. In such a case, the exhaust air is exhausted into the atmosphere by the exhaust operation of the microwave oven.

That is, the exhaust air is discharged into the atmosphere through the exhaust passage by the operation of the exhaust motor 22. The exhaust course of the exhaust air is described by arrows of FIG. 2.

The exhaust air is introduced into the microwave oven through the filter 32 of the base panel 30. Thereafter, such exhaust air is introduced into the instrument compartment 14 through the exhaust channel 18*a* of the lower panel 18. In such a case, the air is introduced toward the upper portion of the compartment 14 along the internal passage formed by the air guide 17 because the exhaust channel 18*a* is longitudinally formed on the right-side portion of the lower panel 18. Thereafter, this exhaust air is introduced into the interior of the air duct 20 through the rear portion 24 of the air duct 20, communicating with the rear portion of the instrument compartment 14.

In addition, the air, introduced from the rear portion of the air duct 20, is exhausted into the atmosphere through the exhaust holes 34*a* of the cover 34.

However, such a known exhaust construction of the microwave oven has problems as will be described below.

The exhaust channel 18*a* is longitudinally formed on the right-side portion of the instrument compartment 14, while the exhaust motor 22 is located at a position around the rear portion of the instrument compartment 14. That is, the length of the exhaust passage is very long, thus reducing an exhaust efficiency of the microwave oven. In addition, such an exhaust passage is bent at an angle of 90°, when viewed from the front position of the microwave oven. Thus, the energy of the air current, passing through the exhaust course, is reduced during the flowing of the air. Also, the above exhaust course is complicated because the exhaust passage is longitudinally formed on the lower panel and is formed from the lower to the upper portions of the instrument compartment. Therefore, the exhaust efficiency of the microwave oven is reduced.

Furthermore, the entirety of electronic equipment has to be installed in the instrument compartment 14. That is, this electronic equipment, generating microwaves, is mounted at the inside portion of the air guide plate 17, which is longitudinally mounted in the instrument compartment 14. As a result, the mount structure of the electronic equipment is complicated.

Due to such complication of the above construction of the microwave oven, the cooling function, capable of cooling the magnetron and the high voltage transformer in the compartment 14, is reduced. Also, both the air guide plate 17 and the cover 34 have to be separated from the cooking cavity assembly 10 when it is necessary to repair the microwave oven. As a result, it is difficult to repair and assemble the conventional microwave oven.

SUMMARY OF THE INVENTION

Accordingly, the present invention has been made with the above problems of conventional microwave ovens in mind, and an object of the present invention is to provide an exhaust structure for ventilation-hooded microwave ovens, of which the exhaust air passage is simplified, thereby effectively discharging exhaust air of the microwave oven into the atmosphere using an exhaust motor.

In order to accomplish the above object, the present invention provides an exhaust structure for ventilation-hooded microwave ovens, comprising: an exhaust motor mounted to the rear portion of an air duct so as to generate an exhaust air current; an instrument compartment divided into front and rear portions by an air guide plate, with microwave generating electronic equipment being installed at the front portion of the instrument compartment; an internal exhaust passage formed at the rear portion of the instrument compartment; and a lower panel mounted at the lower portion of the instrument compartment, the lower panel having exhaust holes communicating with the internal exhaust passage, thus allowing the exhaust passage to be linearly formed on the same plane at a position between the exhaust motor and the lower panel.

The air duct is partially cut at a position corresponding to the internal exhaust passage so as to form an opening for allowing an intake port of the exhaust motor to be located.

The exhaust structure further comprises a base panel mounted to the lower portion of the microwave oven and a filter mounted to the base panel for filtering the exhaust air. Also, the filter communicates with the exhaust holes of the lower panel.

The electronic equipment is mounted to both the upper and lower portions of the instrument compartment, and a fan assembly, used for cooling said electronic equipment, is mounted to said air duct.

BRIEF DESCRIPTION OF THE DRAWINGS

The above object, and other features and advantages of the present invention will be more clearly understood from the following detailed description taken in conjunction with the accompanying drawings, in which.

DESCRIPTION OF THE PREFERRED EMBODIMENT

Figure 1:
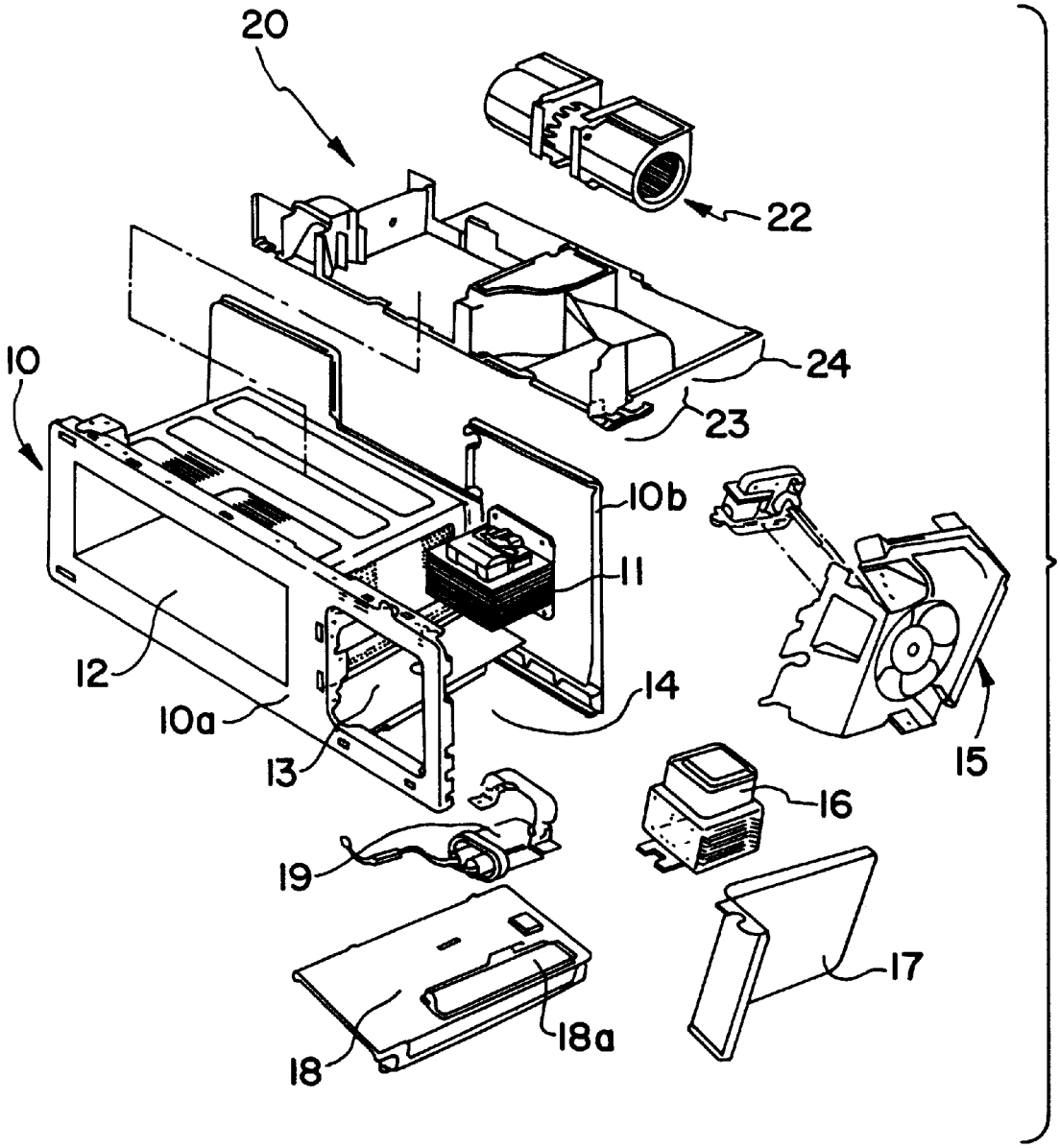
FIG. 1 (PRIOR ART)
FIG. 1 is an exploded perspective view of a conventional ventilation-hooded microwave oven for OTRs.
Figure 2:
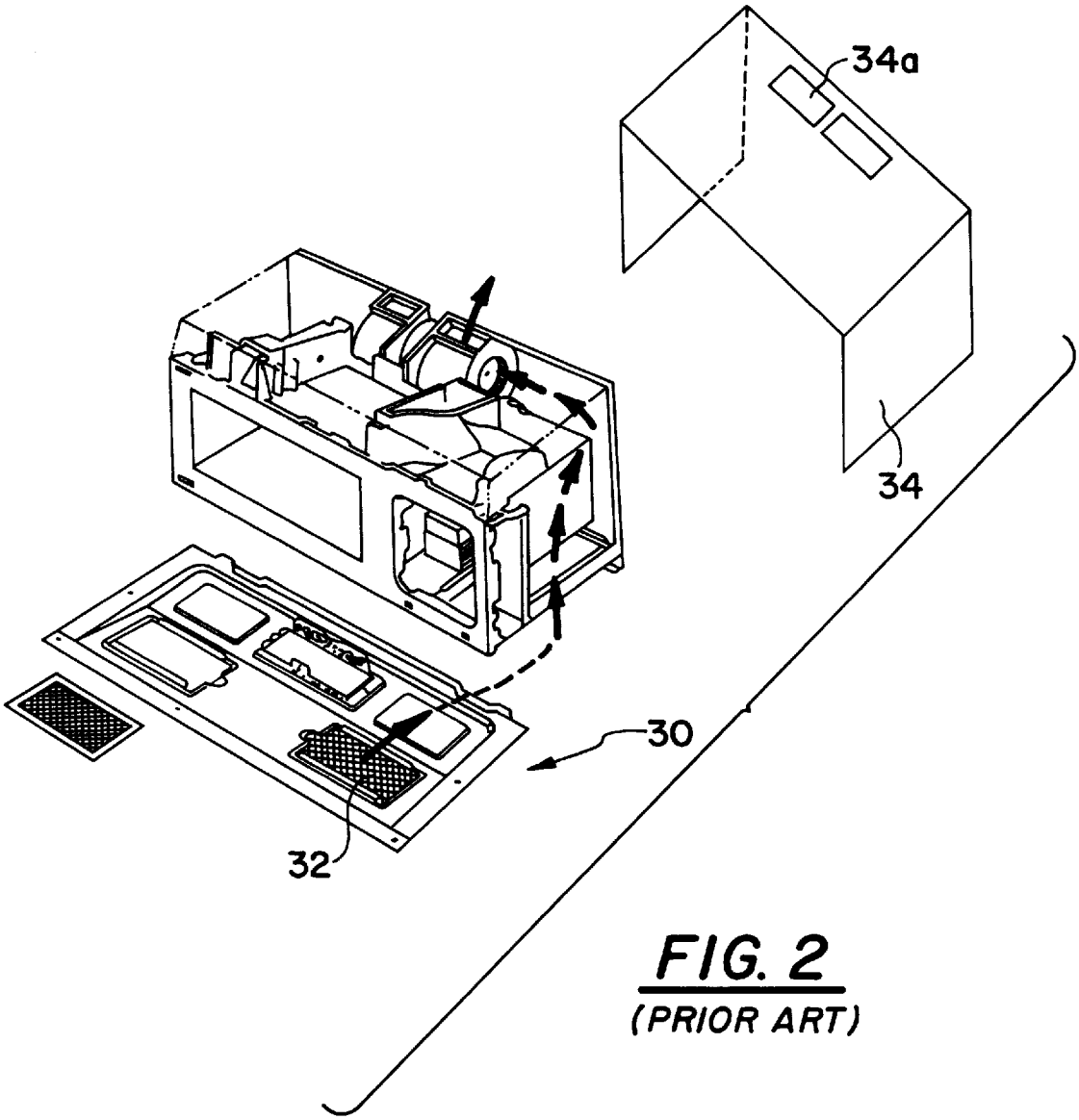
FIG. 2 (PRIOR ART)
FIG. 2 is a perspective view illustrating an exhaust structure for conventional ventilation-hooded microwave ovens.
Figure 3:
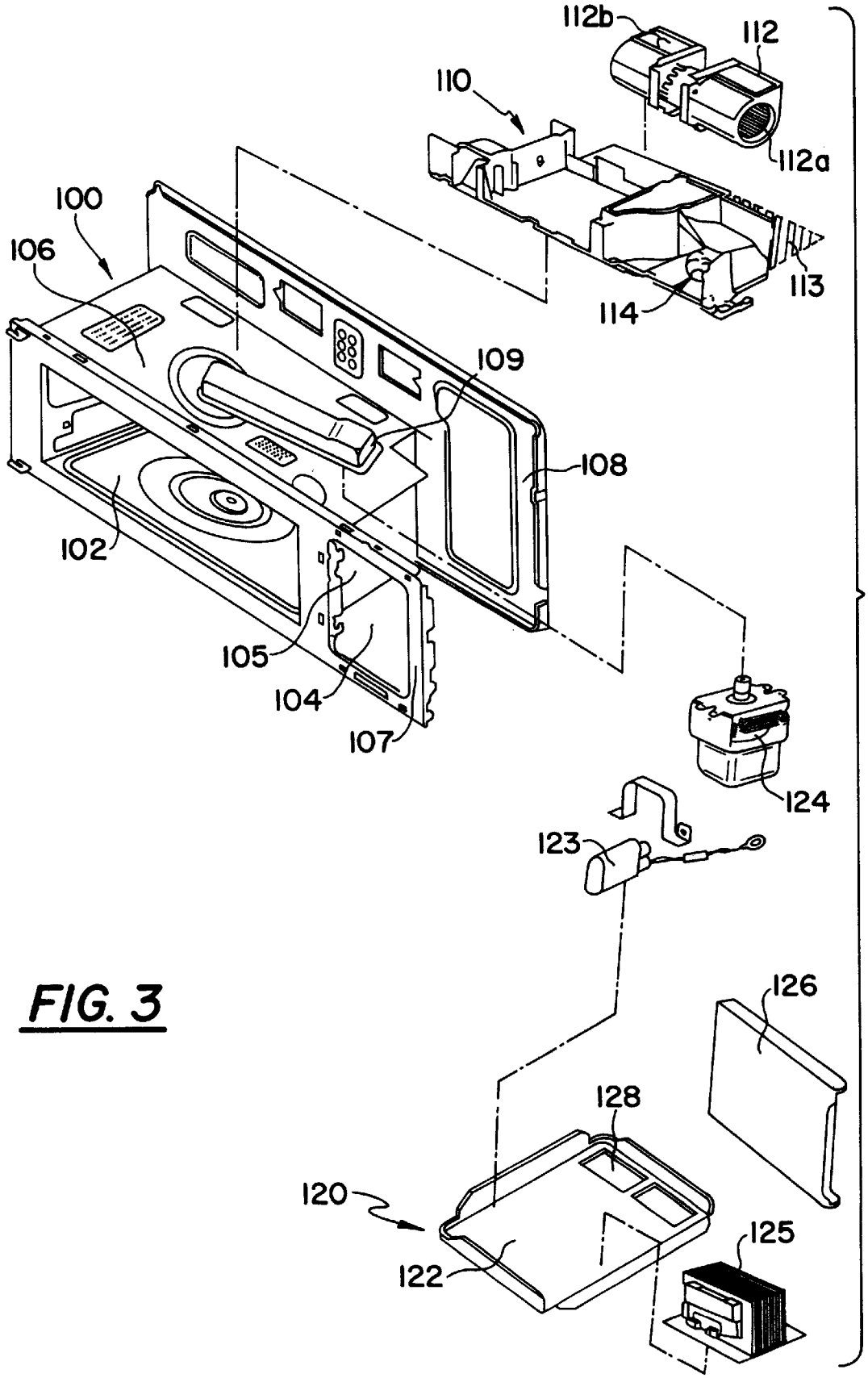
FIG. 3 is an exploded perspective view of a ventilation-hooded microwave oven for OTRs in accordance with the preferred embodiment of the present invention.

FIG. 3 is a view illustrating the construction of a microwave oven for OTRs in accordance with the present invention.

In FIG. 3, an instrument compartment 104 is formed on the right-side position of a cooking cavity assembly 100. The instrument compartment 104 is divided by both a cooking cavity 102 and cavity wall 105. Also, a vent hole (not shown) is formed on the cooking cavity wall 105, while the instrument compartment 104 communicates with the cooking cavity 102 by the vent hole. A lower panel 120, consisting of the lower portion of the instrument compartment 104, is mounted to the front and rear panels 107 and 108 of the compartment 104 by a plurality of screws.

A magnetron 124, used for generating microwaves, is mounted to the arm 109 extending from the upper portion 106 of the cooking cavity 102, when the upper portion of the instrument compartment 104 is mounted to the cooking cavity 102. Due to such a magnetron 124, the invention remarkably improves the space utilization of the compartment 104 in comparison with the conventional instrument compartment.

Figure 4:
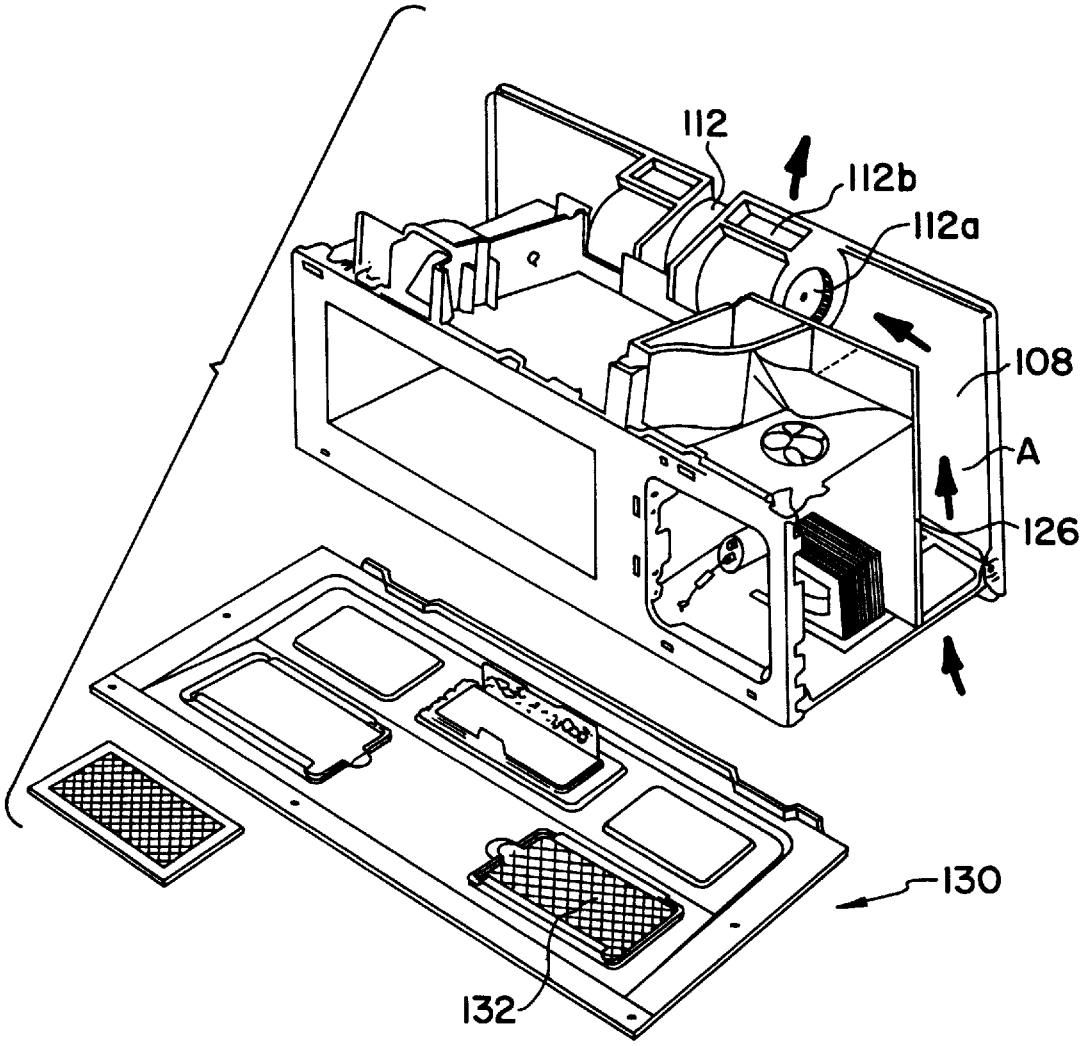
FIG. 4 is a perspective view illustrating an exhaust structure for ventilation-hooded microwave ovens in accordance with the present invention.

The electronic equipment, such as a high voltage transformer 125 and a condenser 123 used for supplying a high voltage to the magnetron 124, is mounted to the lower panel 120 by threading the screws through a plurality of screwing holes 122 formed on the panel 120. In addition, as shown in FIG. 4, the electronic equipment, used for generating the microwaves, is mounted to both the upper portion 106 of the cooking cavity 102 and the lower portion 120 of the instrument compartment 104. Also, exhaust holes 128 are formed on the rear portion of the lower panel 120, thus forming an exhaust course as will be described bellow.

In addition, such electronic equipment is located at the front position of the instrument compartment 104, while an air guide plate 126 is mounted at the rear position of the compartment 104. Thus, an internal exhaust passage A is formed at the rear position of the compartment 104 by the air guide plate 126 as shown in FIG. 4. Such an exhaust passage A serves to exhaust smoke, generated from a gas oven, into the atmosphere by means of an exhaust motor mounted to the air duct 110.

A fan assembly 114, serving to cool the electronic equipment and exhaust the smoke of the cooking cavity 102 into the atmosphere, is mounted to the right-side position of an air duct 110. That is, the fan assembly 114 is positioned above the electronic equipment in the instrument compartment 104. Thus, the electronic equipment, mounted to the lower portion of the compartment 104, is effectively cooled by the fan assembly 114. In addition, a typical exhaust motor 112 is mounted to the rear portion of the air duct 110, while the motor includes both an intake port 112*a* at its side portion and an exhaust port 112*b* at its upper surface.

Also, the air duct 110 is partially cut at a position 113, corresponding to the internal exhaust course in the rear portion of the conventional instrument compartment 104. Thus, the intake port 112*a* of the exhaust motor 112 is located at the position 113. That is, due to the removal of the position 113 as shown as a slantly lined area in FIG. 3, the exhaust passage A of the instrument compartment 104 is directly connected to the intake port 112*a* of the motor 112.

A base panel 130, consisting of the floor portion of a outer casing, is mounted to the lower portion of the cooking cavity assembly 100. Also, a filter 132 is mounted to the base panel 130 so as to communicate with the exhaust passage A and is used for purifying the exhaust air. As shown in FIG. 4, such a filter 132 is located at the front position of the compartment 104, but the filter 132 may be located at the same position as the exhaust holes 128 of the lower panel 120.

The exhaust operation of the microwave oven of this invention is described below.

When the microwave oven is turned on, the fan assembly 114, mounted to the air duct 110, is started. Thus, the exhaust motor 112 is rotated. Due to the rotation of the motor 112, the exhaust air, generated from a gas oven, is exhausted into the atmosphere.

In the exhaust course according to this invention, the internal exhaust passage A is formed between the rear portion 108 of the cooking cavity assembly 100 and the air guide plate 126 of the instrument compartment 104. In addition, the lower portion of the exhaust passage A communicates with the filter 132 of the base panel 130 through the exhaust holes 128 of the lower panel 120, while the upper portion of the exhaust passage A directly communicates with the exhaust motor 112 through the removed position 113 of the air duct 110 as shown in FIG. 3.

That is, the lower portion of the exhaust passage A, formed on the rear portion of the instrument compartment 104, linearly communicates with the outside of the microwave oven, while the upper portion of the passage A communicates with the intake port 112*a* of the exhaust motor 112.

As a result, such an exhaust passage A is linearly formed from the exhaust holes 128 of the lower panel 120 to the intake port 112*a* of the motor 112. That is, the exhaust passage is formed into one plane shape without bending.

Therefore, the exhaust efficiency of the microwave oven is increased because the exhaust air linearly and smoothly flows through the exhaust passage without interfering with the passage.

Also, the fan assembly 114 is mounted to the air duct 110, installed over the upper portion of the cooking cavity, while the electronic equipment is mounted at a position under the fan assembly 114. Thus, the invention remarkably improves the cooling efficiency of the fan assembly 114 in comparison with the conventional fan assembly art.

In addition, the inside space of the instrument compartment is widened by means of the air guide plate being formed into a plane shape. Thus, the magnetron and the high voltage transformer, etc. are easily mounted in the instrument compartment. Also, the microwave oven of this invention may be easily repaired because a user directly accesses the malfunctioning electronic equipment after removing the cover.

As mentioned above, the exhaust structure for ventilation-hooded microwave ovens in accordance with the present invention is provided with an internal exhaust passage linearly formed between the exhaust holes of the lower panel and the intake port of the motor, thereby increasing the exhaust efficiency. Also, the cooling efficiency of electronic equipment in the instrument compartment is improved by means of the fan motor, which is mounted to the air duct.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. An exhaust structure for a ventilation-hooded microwave oven, comprising:

an exhaust motor mounted to a rear portion of an air duct so as to generate an exhaust air current;

an instrument compartment divided into front and rear portions by an air guide plate, with microwave generating electronic equipment being installed at the front portion of said instrument compartment;

an internal exhaust passage formed at the rear portion of said instrument compartment; and a lower panel mounted at a lower portion of said instrument compartment, said lower panel having exhaust holes communicating with said internal exhaust passage, thus allowing said internal exhaust passage to be linearly formed on a same plane at a position between said exhaust motor and said lower panel, through said air duct.

2. The exhaust structure according to claim 1, wherein said air duct is partially cut at a position corresponding to said internal exhaust passage so as to form an opening for allowing an intake port of said exhaust motor to be located.

3. The exhaust structure according to claim 1, further comprising:

a base panel mounted to a lower portion of the microwave oven; and a filter mounted to said base panel for filtering exhaust air.

4. The exhaust structure according to claim 3, wherein said filter communicates with said exhaust holes of said lower panel.

5. The exhaust structure according to claim 4, wherein said electronic equipment is mounted to both an upper portion and the lower portion of said instrument compartment, and a fan assembly, used for cooling said electronic equipment, is mounted to said air duct.

6. The exhaust structure according to claim 2, further comprising:

a base panel mounted to a lower portion of the microwave oven; and a filter mounted to said base panel for filtering exhaust air.

7. The exhaust structure of claim 1, wherein said instrument compartment is along a first side portion of the microwave oven, a cooking compartment being located along an opposite second side portion of the microwave oven.

8. An exhaust structure for a ventilation-hooded microwave oven comprising:

an exhaust motor mounted to a rear portion of an air duct to generate on exhaust air current;

an instrument compartment formed along a side portion of the microwave oven;

an air guide plate mounted within said instrument compartment to provide a front portion and a rear portion of said instrument compartment;

an internal exhaust passage formed in the rear portion of said instrument compartment; and a lower panel mounted on a lower portion of said instrument compartment and including exhaust holes in communication with said internal exhaust portion, linear exhaust flow being provided between said exhaust motor and said lower panel through said air duct, via said internal exhaust passage.

9. The exhaust structure of claim 8, further comprising electronic equipment mounted within the front portion of said instrument compartment for generating microwaves.

10. The exhaust structure of claim 9, further comprising a fan assembly for cooling said electronic equipment.

11. The exhaust structure of claim 8, further comprising:

a base panel mounted to a lower portion of the microwave oven; and a filter mounted to said base panel for filtering exhaust air.

12. The exhaust structure of claim 11, wherein said filter communicates with the exhaust holes of said lower panel.

13. The exhaust structure of claim 8, wherein said instrument compartment is along a first side portion of the microwave oven, a cooking compartment being located along an opposite second side portion of the microwave oven.

14. The exhaust structure of claim 8, wherein said air duct is partially cut at a position corresponding to said internal exhaust passage to form an opening to permit exhaust flow therethrough.

* * * * *